United States Patent [19]

Garblik

[11] Patent Number: 4,715,151

[45] Date of Patent: Dec. 29, 1987

[54] PLASTERBOARD REPAIR KIT

[76] Inventor: Alvin Garblik, 407 S. Almonesson Rd., Deptford, N.J. 08096

[21] Appl. No.: 1,612

[22] Filed: Jan. 8, 1987

[51] Int. Cl.[4] ..... E04G 23/02

[52] U.S. Cl. ..... 52/2; 52/514

[58] Field of Search ..... 52/2, 514

[56] References Cited

U.S. PATENT DOCUMENTS 2,652,168 9/1953 Nelson ..... 52/2

2,771,899 11/1956 Swallert ..... 52/2

OTHER PUBLICATIONS

Popular Mechanics, Oct. 1963, p. 148.

*Primary Examiner*—John E. Murtagh

*Attorney, Agent, or Firm*—Norman E. Lehrer

[57] ABSTRACT

A plasterboard repair kit for use in patching a hole in a plaster wall includes a substantially cube-shaped inflatable member comprised of a flexible but substantially inelastic plastic. The front wall of the inflatable member includes a valved opening therein through which the device can be inflated and an interior retainer extends between the front and rear walls to prevent them from bulging after inflation. In its deflated form, the device is inserted into the cavity behind a hole in a plaster or plasterboard wall and is then inflated utilizing a carbon dioxide cartridge in a holder having a nozzle inserted into the opening. After inflation, the inflated member acts as a seal behind the hole so that the hole can then be filled with plaster or other patch material.

6 Claims, 7 Drawing Figures

PLASTERBOARD REPAIR KIT

BACKGROUND OF THE INVENTION

The present invention is directed toward a plasterboard repair kit and more particularly toward a kit which includes an inflatable device which can be easily used by the average handyman to repair a hole in a plasterboard or plaster wall.

As is well known by those skilled in the art and by the average homeowner, small holes such as nail holes which are left after removing a picture hanger from the wall or the like can be easily repaired with a small amount of Spackling compound or similar material. Slightly larger holes in a plaster or plasterboard wall can also be repaired with Spackling compound although it may require two or more applications of the same. However, a hole which may be two or three inches in diameter cannot easily be repaired using Spackling compound alone and creates an entirely different problem.

Although a larger diameter hole can be repaired by applying a small amount of Spackle around the periphery of the hole, allowing it to dry and then repeating the process several times, this procedure is very time-consuming. Furthermore, it is unlikely that the patch will hold since there would be nothing behind the hole to maintain the patch in place. Accordingly, even a small amount of pressure on the patched wall part would cause the patch to merely move backwardly into the hollow space behind the wall.

A common technique for repairing holes of several inches in diameter is to stuff crumbled newspaper or similar material into the hole to form a backing for the plaster or Spackling compound repair material. This, however, has not proved to be a very satisfactory solution since the liquid in the plaster or Spackling compound can soak the paper making it less resilient. Furthermore, the paper often falls downwardly from behind the hole. Even further, after the patch is in place, the paper does not provide sufficient support and can sometimes create a fire hazard.

Mechanical devices have been proposed in the past which are intended to be inserted into the hole to support a plaster or Spackling compound patch. These are shown, for example, in U.S. Pat. Nos. 3,226,893; 3,325,955; 3,583,122; 3,690,084; 3,834,107; 3,874,505; 3,936,988; 3,999,347; 4,062,165 and 4,075,809. These patents show various types of devices ranging from a simple adhesive patch to complex mechanical spring-loaded devices which are intended to be inserted into the hole to provide support from behind. To Applicant's knolwedge, none of these proposed devices have ever been successfully utilized.

Insofar as Applicant is aware, only one attempt has been made to utilize an inflatable device to aid in repairing a hole in a plasterboard wall. Page 148 of the October 1963 issue of *Popular Mechanics* magazine suggests that a toy balloon can be used to press a square of cardboard against the back side of the hole. It is suggested that the mouth of the balloon be passed through a hole in the piece of cardboard and that the balloon be inflated after both the balloon and the cardboard are stuffed into the hole. While this appears to be a possible solution in principle, in practice it does not appear to be bery effective. Such balloons are easily broken when inflated by sharp objects or uneven surfaces within the hole. It is also difficult to inflate the balloon since one has to get their mouth right at the wall and this is particularly difficult if the hole is in a very high or very low place. It has also been found to be difficult to tie the end of the balloon in a knot since very little is exposed through the piece of cardboard. Even further, toy balloons have relatively porous walls and within a few hours, the balloon begins to deflate, thereby providing no rear support.

SUMMARY OF THE INVENTION

The present invention is designed to overcome all of the deficiencies of the prior art and to provide a simple and inexpensive device for patching a hole in a plaster or plasterboard wall. The repair kit of the invention includes a substantially cube-shaped inflatable member comprised of a flexible but substantially inelastic plactic. The front wall of the inflatable member includes a valved opening therein through which the device can be inflated and an interior retainer extends between the front and rear walls to prevent them from bulging after inflation. In its deflated form, the device is inserted into the cavity behind a hole in a plaster or plasterboard wall and is then inflated utilizing a carbon dioxide cartridge in a holder having a nozzle inserted into the opening. After inflation, the inflated member acts as a seal behind the hole so that the hole can then be filled with plaster or other patch material.

BRIEF DESCRIPTION OF THE DRAWINGS

For the purpose of illustrating the invention, there is shown in the accompanying drawing one form which is presently preferred; it being understood that the invention is not intended to be limited to the precise arrangements and instrumentalities shown.

DETAILED DESCRIPTION OF THE PREFERRED EMBODIMENT

Figure 1:
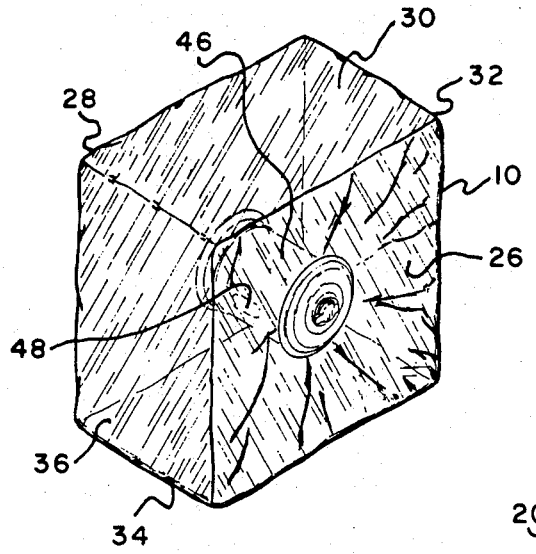
FIG. 1 is a front perspective view of a fully inflated expandable member utilized with the plasterboard repair kit and constructed in accordance with the principles of the present invention.

Referring now to the drawings in detail wherein like reference numerals have been used throughout the various figures to designate like elements, there is shown in the drawings a plasterboard repair kit which is comprised essentially of three components: an inflatable member 10, a cartridge 12 of compressed gas such as carbon dioxide or the like and a cartridge holder 14. The kit and particularly the inflatable member 10 is intended to be used to repair a hole such as shown at 16 in a plaster wall or plasterboard wall 18. As is well known in the art, such walls normally have a hollow space such as shown at 20 behind the wall 18. The depth of this space is normally about four inches and is created by the wall studs 22 supporting the two plasterboard walls 18 and 24.

The inflatable member 10 is comprised essentially of a flexible but substantially inelastic plastic sheet material such as polyvinylchloride or the like of approximately 19 mls. thick. The inflatable member includes a front wall 26, a rear wall 28 and peripheral walls comprised of top wall 30, right wall 32, bottom wall 34 and left side wall 36. In the preferred embodiment, the front and rear walls 26 and 28 are square and approximately six or seven inches on each side. The peripheral walls have a length of approximately six or seven inches and a depth of approximately four inches.

The inflatable member 10 has a substantially hollow interior and is totally airtight. A valve opening 38, however, is substantially centrally located in the front wall 26 for permitting air or gas to be introduced into the interior of the member for inflating the same. Opening 38 includes a tube 40 which leads to the interior of the inflatable member. A flap valve 42 at the end of the tube 40 allows gas to be introduced through the opening and through the tube 40 into the interior of the inflatable member but prevents gas from exiting therethrough. A plug 44 is forced into the opening 38 after the member 10 is inflated to further help to prevent air from flowing out.

For reasons which will become clearer hereinafter, it is desirable to prevent the central portions of the front and rear walls 26 and 28 from bulging outwardly when the member 10 is inflated. This would normally occur due to the flexibility of the plastic sheet material from which the member 10 is made. This is accomplished by an interior retaining member 46 in the form of a tube. If the depth of each of the peripheral walls is four inches, then the length of the tube 46 will also be approximately four inches. The forward end of the tube 46 is secured to the inner surface of the front wall 26 substantially centrally thereof and the rear end of the tube 46 is secured to the inner surface of the rear wall 28 substantially thereof. The side walls of the tube 46 are provided with a plurality of openings such as shown at 48.

The member 10 is inflated with gas such as carbon dioxide from the cartridge 12. Cartridge 12 is of well known construction having a cylindrically shaped housing and a valve 50 at the forward end thereof which allows gas to be discharged from the cartridge when a pin or needle or the like is inserted into the valve 50. In order to ensure proper operation of the inflatable member 10, i.e. to ensure that it is neither underinflated nor overinflated, the cartridge 12 is filled with only enough gas to substantially inflate the inflatable member 10 at room temperature.

Figure 5:
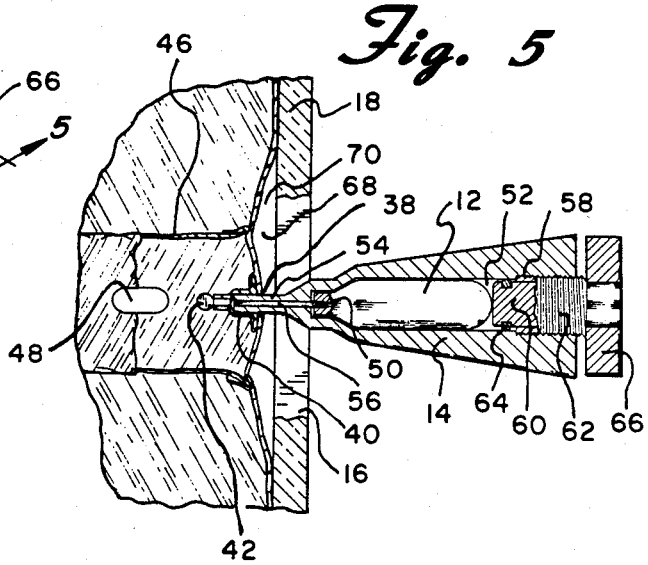
FIG. 5 is a cross-sectional view taken through the line 5—5 of FIG. 4.

The plasterboard repair kit also includes a specially designed holder 14 for the cartridge 12. Holder 14 includes an interior chamber 52 which is substantially complementarily shaped to the cartridge 12 as shown most clearly in FIG. 5. Located at the forward end of the cartridge holder 14 is an elongated nozzle 54 which is adapted to be inserted into the opening 38 in the inflatable member 10. A hollow pin 56 is located within the nozzle 54 and extends rearwardly into the forward end of the chamber 52. The distal end of the pin 56 is adapted to engage the valve 50 of the cartridge 12. The rear end of the chamber 52 includes an internal thread 58 into which is adapted to be threaded a plug member 60 having a complementary external thread 62 thereon. The forward end of the plug 60 includes an O-ring 64 which prevents gas from exiting through the rear of the chamber 52. Plug 60 is also provided with a handle 66 which, when rotated clockwise, screws the plug 60 into the chamber 52. As this occurs, the forward end of the plug 60 pushes the cartridge 12 forwardly until the pin 56 engages the valve 50 whereby gas from the cartridge passes out through the nozzle 54.

Figure 2:
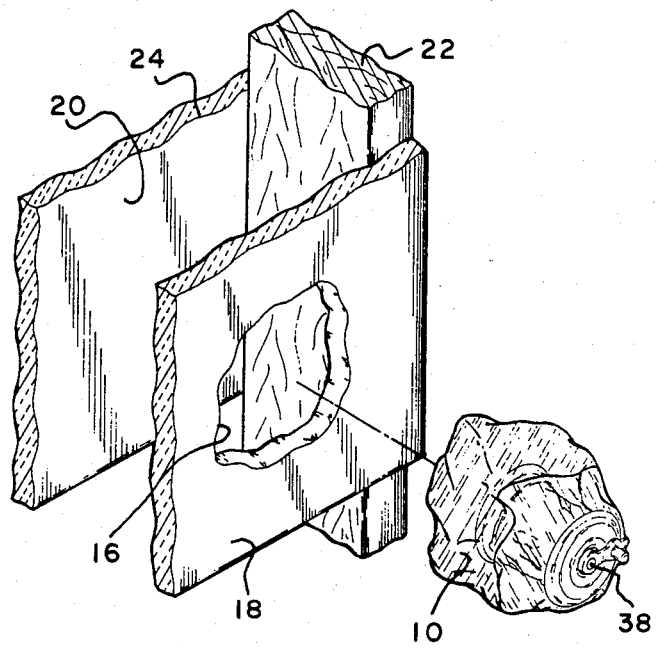
FIG. 2 is a perspective view illustrating the first step in utilizing the present invention.
Figure 3:
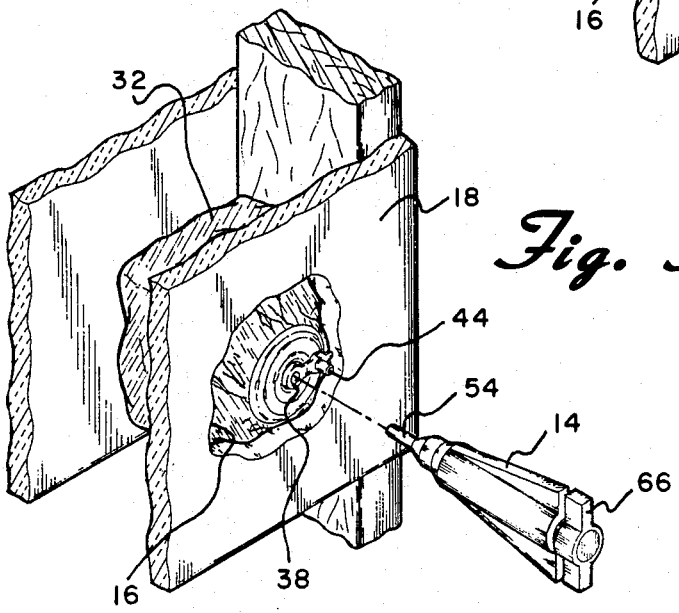
FIG. 3 is a view similar to FIG. 2 showing the inflatable member in place and ready to be inflated.
Figure 4:
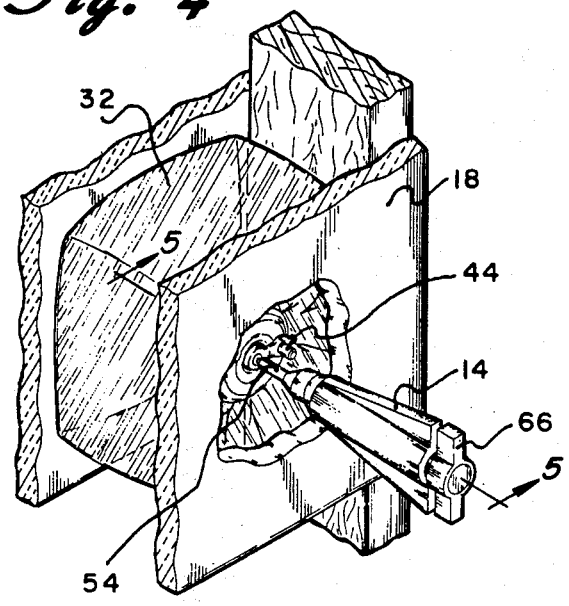
FIG. 4 is a view similar to FIG. 3 showing the inflatable member in place and fully inflated.

The manner in which the plasterboard repair kit of the present invention is utilized to patch a hole in a plasterboard wall is illustrated in FIGS. 2-7. The hole 16 to be patched must, of course, have a diameter which is less than the diamter of the inflatable member 10. In its deflated form as shown in FIG. 2, the member 10 is inserted into the hole 16 in the wall 18. A cartridge 12 is inserted into the cartridge holder 14 and the plug 60 is loosely screwed onto the back of the cartridge holder. The nozzle 54 is then inserted into the opening 38 in the front wall 26 of the inflatable member 10. As the handle 66 is turned, gas is eventually discharged from the cartridge 12 through the tube 40 and into the tubular retaining member 46. From there, it passes through the openings 48 into the remaining interior portions of the inflatable member 10. Gas continues to flow until the inflatable member is fully expanded. At this point, the cartridge holder 14 is removed and the plug 44 is inserted into the opening 38.

Figure 7:
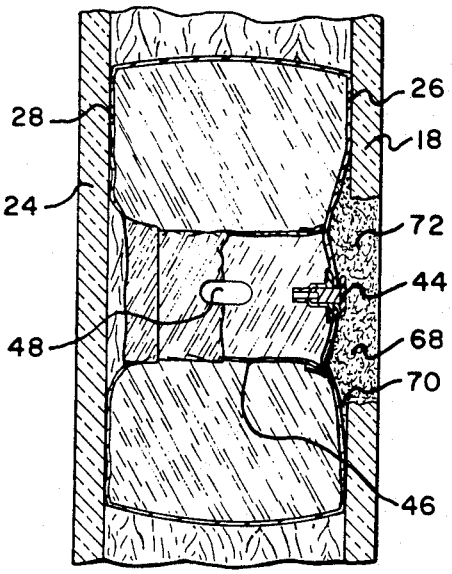
FIG. 7 is a cross-sectional view taken through the line 7—7 of FIG. 6 but also showing the hole in the plasterboard being filled with plaster or Spackling compound.

As shown most clearly in FIG. 7, when the inflatable member 10 is fully inflated, all of the walls thereof tend to bulge slightly. As a result, the front and rear walls 26 and 28 form a tight seal with the inner surfaces of the plasterboard walls 18 and 24, respectively. However, due to the inclusion of the interior retaining member 46, the central portions of the front and rear walls 26 and 28 will not bulge but, rather, will be slightly indented. If the retaining member 46 were not utilized, the central portion of the front wall 26 including the opening 38 might tend to bulge out through the hole 16 in the wall 18. The retaining member 46 not only prevents this but provides a hollow space behind the hole 16 into which Spackling can be placed. Even further, a hollow space 70 remains between the front wall 26 and the inner surface of the wall 18 in the area around the periphery of the hole 16 as is shown most clearly in FIG. 5.

Figure 6:
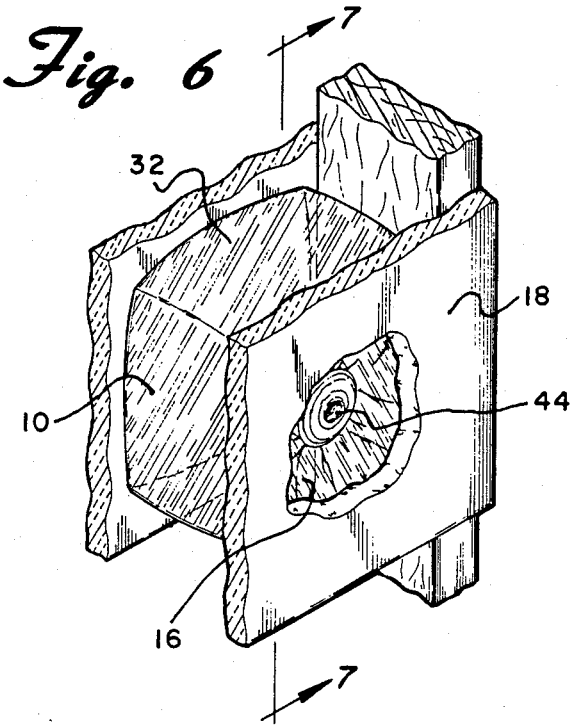
FIG. 6 is a view similar to FIG. 4 showing the inflatable member fully inflated and with the valve cover closed.

After the inflatable member 10 is in place and fully inflated as shown in FIG. 6, the hole 16 is then filled with plaster or a Spackling compound 72. The patch material 72 fills the entire space 68 and the space 70. Because the inflatable member 10 does not allow air to get to the back surface of the patch material 72 so as to dry the same, it is preferable to apply several light coats of the material 72 and allow each coat to dry before the next application. After the last application, the face of the patch material 72 can be sanded so as to be flush with the front surface of the wall 18 as shown in FIG. 7. As is also shown in FIG. 7, when the patch material 72 drys in the area 70, it is locked in place thereby helping to prevent the final patch from coming loose.

The present invention may be embodied in other specific forms without departing from the spirit or essential attributes thereof and accordingly reference should be made to the appended claims rather than to the foregoing specification as indicating the scope of the invention.

I claim:

1. A plasterboard repair kit for use in patching a hole in a plasterboard comprising:

an inflatable member, said member being comprised of flexible but substantially inelastic plastic and including a front wall, a rear wall and peripheral side walls, an opening in said front wall for permitting gas to be introduced into the interior of said member for inflating the same and including valve means for preventing gas from exiting from said member;

said inflatable member, when fully inflated and unrestricted by any outside structure, being substantially rectangular in shape;

said opening being formed by a structural member which extends forwardly substantially no further than the exterior surface of said front wall;

a gas cartrigde, said cartridge containing only enough gas to substantially inflate said inflatable member at room temperature, and a holder for said cartridge, said holder including a nozzle means adapted to fit within said opening and further including means for releasing gas from said cartridge and directing the same through said nozzle so that it can enter said opening to inflate said inflatable member.

2. The invention as claimed in claim 1 wherein said gas cartridge contains carbon dioxide.

3. The invention as claimed in claim 1 wherein said opening in said front wall includes a tube movable between a first position wherein it extends outwardly to the exterior of said inflatable member and a second position wherein is extends inwardly to the interior thereof.

4. The invention as claimed in claim 1 further including an interior retaining means within said inflatable member connected to and extending between said front and rear walls to prevent them from bulging outwardly when said inflatable member is inflated.

5. The invention as claimed in claim 4 wherein said retaining means is connected to the interior surface of said front wall and substantially centrally thereof.

6. The invention as claimed in claim 5 wherein said retaining means is substantially tubularly shaped.

* * * * *